United States Patent [19]

Kato

[11] Patent Number: 4,557,476

[45] Date of Patent: Dec. 10, 1985

[54] CIGARETTE CASE JUGGLERY DEVICE

[75] Inventor: Hideo Kato, Tokyo, Japan

[73] Assignee: Tenyo Co., Ltd., Tokyo, Japan

[21] Appl. No.: 632,645

[22] Filed: Jul. 20, 1984

[51] Int. Cl.[4] ..... A63J 21/00; E05B 37/20

[52] U.S. Cl. ..... 272/8 N; 70/289; 206/1.5

[58] Field of Search ..... 272/8 R, 8 N, 8 D, 27 N; 70/289; 206/1.5

[56] References Cited

U.S. PATENT DOCUMENTS

| | | | |
|---|---|---|---|
| 158,106 | 12/1874 | McGurk | 70/289 UX |
| 535,291 | 3/1895 | Kracker | 206/1.5 |
| 889,568 | 6/1908 | Albrecht | 206/1.5 |
| 1,023,276 | 4/1912 | Rouse | 206/1.5 |
| 1,163,773 | 12/1915 | Ross | 70/289 UX |
| 1,163,775 | 12/1915 | Rouse | 206/1.5 |
| 1,266,647 | 5/1918 | Wickberg | 206/1.5 |
| 1,293,062 | 2/1919 | Erdey | 206/1.5 |
| 2,424,642 | 7/1947 | Towne et al. | 206/1.5 |

*Primary Examiner*—Robert Bagwill
*Assistant Examiner*—Arnold W. Kramer
*Attorney, Agent, or Firm*—Murray, Whisenhunt and Ferguson

[57] ABSTRACT

A jugglery device using cigarettes comprises a hollow rectangular parallelpiped casing formed by parallel rectangular upper and bottom walls. A pair of side walls connect opposite side edges of the upper and bottom walls, and an end wall connects opposite end edges of the upper and bottom walls. A drawer assembly is disposed slidably in relation to the bottom wall through the open end of the casing. The drawer accommodates a plurality of cigarettes. The drawer has a bottom wall slidable on the bottom wall of the casing, a pair of side walls and an end wall to connect opposite end edges of the side walls. A first auxiliary end wall protrudes from one of the other opposite end edges of the side wall toward the other end edge. A second bottom wall is slidably disposed on the bottom wall of the drawer assembly and is of nearly the same area as the bottom wall of the drawer assembly. A pair of second auxiliary walls are vertically raised from a part of the opposite end edges, one of the second auxiliary end walls touching a part of the end wall of the drawer assembly when the drawer assembly is in its minimum sliding position in relation to the second bottom wall; while the other second auxiliary end wall forms another end wall of the drawer assembly, and the second bottom wall is selectively engageable with either the drawer assembly or the casing in the minimum sliding position of the drawer assembly with respect to said casing.

9 Claims, 22 Drawing Figures

CIGARETTE CASE JUGGLERY DEVICE

BACKGROUND OF THE INVENTION (a) Field of the Invention

The present invention relates to a jugglery means, and more particularly to an improved and novel jugglery means using cigarettes.

(b) Description of the Prior Art

Many jugglery means of this kind have so far been proposed. For example, a box-shaped cigarette case is well known, which contains several cigarettes which will appear and disappear every time the player opens the drawer of the cigarette case while casting a spell on the box. This jugglery cigarette case has a drawer in which the cigarettes are laid and of which the bottom is of a double structure. That is, the drawer consists of two parts, upper and lower which are slidable in relation to each other and disposed as superposed one over the other within the cigarette case. When the player locks to the case the one of the two drawers in which the cigarettes are laid, while casting a spell, and he pulls out the other drawer from the case, the cigarettes will not be seen from the audience as if they did not exist any more in the cigarette case. When the player inserts the drawer into the case, unlocks the other drawer while casting a spell and pulls out the latter, the cigarettes will appear before the audience.

Such conventional jugglery means using cigarettes provide only two varieties of amusement that the cigarettes simply appear in the drawer of the cigarette case and disappear from there.

SUMMARY OF THE INVENTION

The present invention seeks to provide an improved jugglery means which permits to provide new and various modes of amusement which the conventional jugglery means using cigarettes could not.

The present invention otherwise seeks to provide an improved jugglery means which permits to let the audience have an illusion that plural cigarettes laid in the drawer are produced in an increased number within the cigarette case.

These and other objects and advantages of the present invention will be better understood from the ensuing description made of the embodiment, by way of example, of the present invention with reference to the drawings.

BRIEF DESCRIPTION OF THE DRAWINGS

FIGS. 1 thru 9 show one embodiment of the jugglery means using cigarettes according to the present invention, of which;

FIG. 1 is an exploded perspective view of the inventive jugglery means according to the present invention, showing the general construction;

FIG. 2 is also an exploded perspective view showing the engagement between the first and second drawers;

FIG. 3 is a perspective view showing the drawing in which cigarettes are laid housed in the cigarette case, with the upper part of the case removed from the lower part;

FIG. 4 is a perspective view showing the first drawer pulled out of the cigarette case body;

FIG. 5 is a perspective view showing the first and second drawers pulled out as engaged with each other from the case body;

FIG. 6 is a sectional view of the essential part of the cigarette case showing the first and second drawers engaged with each other;

FIG. 7 is also a sectional view of the essential parts of the cigarette case showing the second drawer and case body engaged with each other, with the first drawer being pulled out of the case body;

FIG. 8 is a sectional view of the essential part of the cigarette case showing the first and second drawers pulled out as engaged with each other from the case body;

FIG. 9 is a bottom view of the case body; and

DETAILED DESCRIPTION OF THE PREFERRED EMBODIMENT

Figure 1:
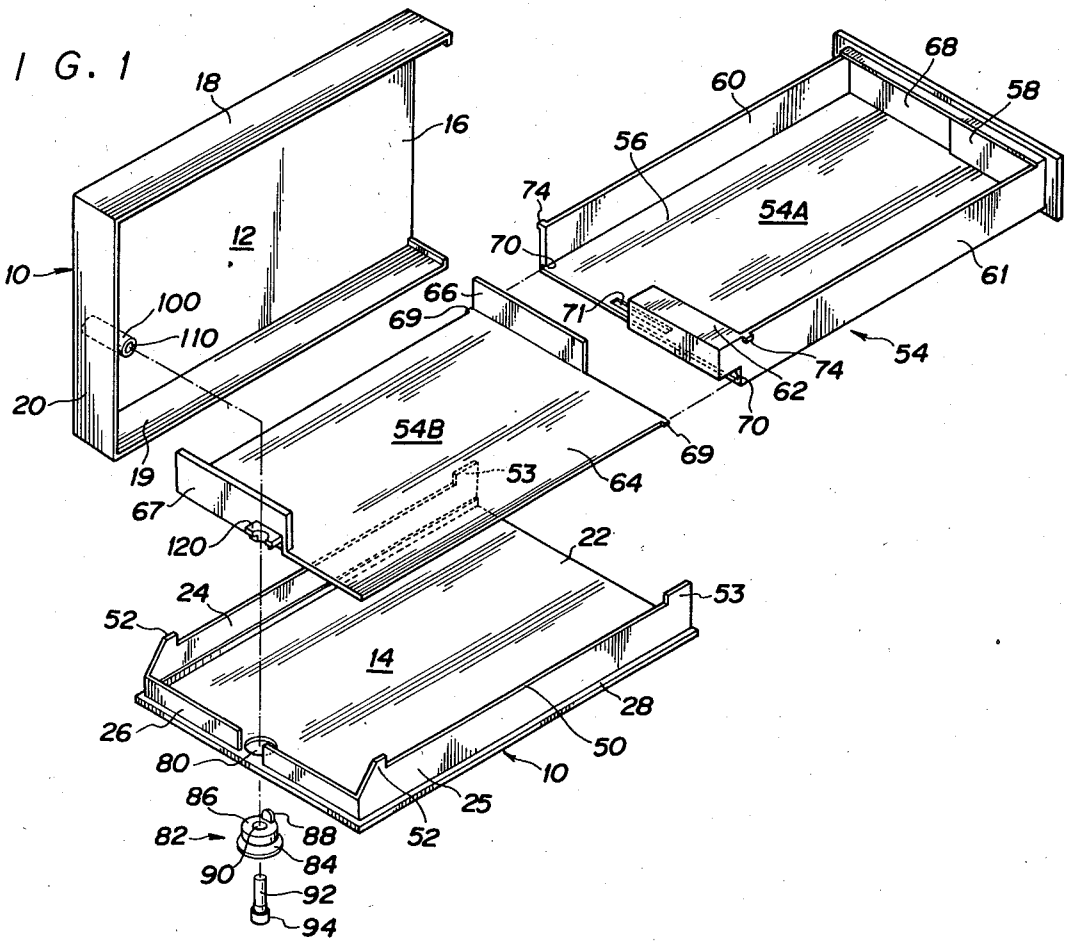
Figure 2:
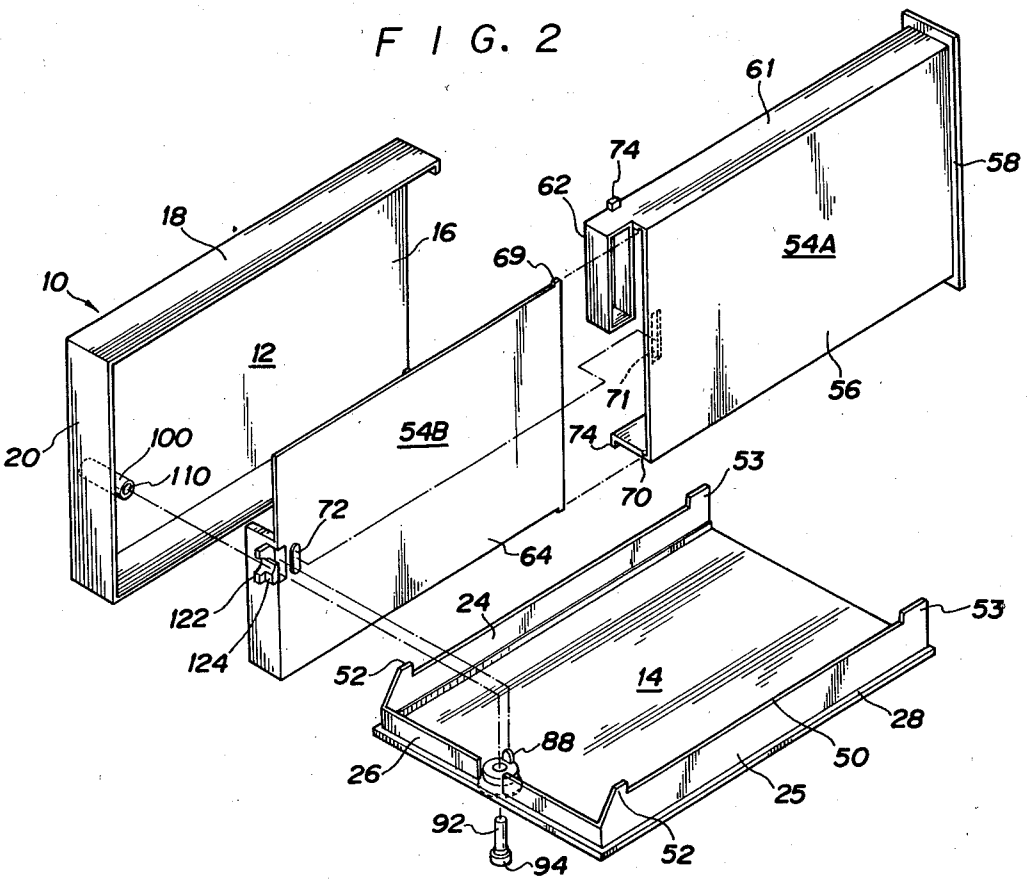

Referring now to Figures, the reference numeral 10 denotes a cigarette case in which cigarettes are to be put. The cigarette case 10 consists of an upper body 12 and lower body 14, both made of a synthetic resin. The upper body 12 is fitted on the lower body 14 to thus form together a box-shaped hollow rectangular parallelpiped. In the hollow portion of this box, a drawer in which cigarettes are to be laid is to be housed. The upper body 12 comprises an upper wall 16, side walls 18, 19 extending from the opposite side edges, respectively, of the upper wall 16, and an end wall 20 extending from one edge of the upper wall 16 and connected to said side walls 18 and 19, respectively. On the other hand, the lower body 14 consists of a bottom wall 22, inner side walls 24 and 25 vertically extending from the bottom wall 22 at the positions a little inside the opposite edges, respectively, and inner end walls 26 vertically extending from the bottom wall 22, respectively, at the position a little inside the inner end of the bottom wall 22 and connected with said inner side walls 24 and 25, respectively. The inner surfaces of the side walls 18 and 19 of the upper body 12 rest on the respective outer surfaces of the inner side walls 24 and 25 of the lower body 14, while the inner surface of the end wall 20 of the upper body 12 rests on the outer surfaces of the inner end walls 26 of the lower body 14. The bottom faces of the side walls 18 and 19 and of the end wall 20 rest on the rims 28 of the bottom wall 22 of the lower body 14. Formed in the inner side walls 24 and 25 of the lower body 14 are guides 50 which will be described later, and the inner side walls 24 and 25 have shoulder pieces 52 and 53 formed at the opposite ends thereof, respectively.

The cigarette case 10 is used with a drawer assembly 54 which consists of a first drawer 54A and second drawer 54B which forms the bottom of the double structure of the drawer assembly 54. The first drawer 54A is so constructed as to slide on the bottom wall 22 of the lower body 14 of the cigarette case 10, and also the second drawer 54B is so formed as to slide on the bottom wall 56 of the first drawer 54A.

More particularly, the rear surface of the bottom wall 56 of the first drawer 54A has a rectangular form and is so formed as to slide on the inner surface of the bottom wall 22 of the lower body 14. There is formed an end wall 58 at the front edge of the first drawer 54A. A pair of side walls 60 and 61 extends from the opposite ends of the end wall 58 and vertically rises from the opposite side edges of the bottom wall 56. At the opposite end of the side wall 61 to the end wall 58, there is formed a first auxiliary end wall 62 nearly parallel to the end wall 58.

The auxiliary end wall 62 is formed as protruded from the end of the side wall 61. Formed between the auxiliary end wall 62 and the edge of the bottom wall 56 is a space through which the second drawer 54B passes.

The second drawer 54B has the bottom wall 64 so formed as to have a nearly same area as the bottom wall 56 of the first drawer 54A. The bottom wall 64 is provided with a pair of second auxiliary end walls 66 and 67 formed as vertically raised from a part of the opposite edges of the bottom wall 64. One of the auxiliary end walls 66 is fittable in a recess 68 formed in the end wall 58 of the first drawer 54A to be flush with the remainder of the end wall 58 while the other auxiliary end wall 67 is so constructed as to form together with the first auxiliary end wall 62 of the first drawer 54A another end wall of the drawer assembly 54. That is to say, the first auxiliary end wall 62 and the second auxiliary end wall 67 have each a length so determined that when the bottom wall 64 of the second drawer 54B is completely superposed on the bottom wall 56 of the first drawer 54A (with the minimum sliding of the drawer), the first auxiliary end wall 62 of the first drawer 54A and the second auxiliary end wall 67 of the second drawer 54B appear to form together one of the end walls of the drawer assembly as a whole. In this embodiment, the width of the second drawer 54B is so selected that seven cigarettes can be accomodated in the drawer assembly 54. The length of the first auxiliary end wall 62 and that of the second auxiliary end walls 66 and 67 are so selected that three cigarettes can be accomodated in a section defined by a part of the end wall 58 of the first drawer 54A, first auxiliary end wall 62 and one of the side walls 61 (will be referred to as "first section" hereafter) and that four cigarettes can be accomodated in a section defined by the pair of opposite second auxiliary end walls 66 and 67 of the second drawer 54B and one of the side walls 60 of the first drawer 54A or one of the side walls 24 of the lower body 14 (will be referred to as "second section" hereafter). Also the second drawer 54B has formed at each of the opposite front ends of the bottom wall 64 where the second auxiliary end wall 66 is formed, a small parallelpiped piece 69 protruding in the direction of the width of the second drawer 54B. These protrusions 69 are slidably fitted in elongated recesses 70 formed longitudinally in the lower portions of the side walls 60 and 61 of the first drawer 54A. The recesses extend along the bottom wall 56. Thus, the first drawer 54A can be smoothly slid in relation to the second drawer 54B.

The first drawer 54A has formed an elongated recess 71 in the bottom wall 56 thereof, and the second drawer 54B has formed thereon a protrusion 72 in a position where it will be engaged in the recess 71 when the bottom wall 64 of the second drawer 54B is completely superposed on the bottom wall 56 of the first drawer 54A (with the minimum sliding of the first drawer 54A). When such complete superposition is made, the protrusion 72 will be engaged in the recess 71 so that the first and second drawers 54A and 54B will be closely attached the former on the latter and can be slid together over the bottom wall 22 of the lower body 14 of the cigarette case 10. The side walls 60 and 61 of the first drawer 54A have protrustions 74 formed at opposite upper ends thereof, respectively, and which are movable on the guides 50 provided on the tops of the side walls 24 and 25, respectively. The moving range of the protrusions is limited by the shoulder pieces 52 and 53. Namely, when the first drawer 54A is housed to full extent in the cigarette case 10 (with the minimum sliding of the first drawer 54A), the projections 74 abut the shoulder pieces 52, respectively, near the end wall 26 of the lower body 14, while the projections 74 abut the other shoulder pieces 53 when the first drawer 54A is pulled out to full extent from the cigarette case 10 (with the maximum sliding of the first drawer 54A).

Figure 6:
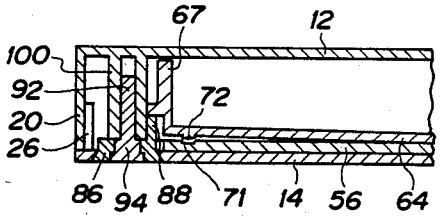
Figure 7:
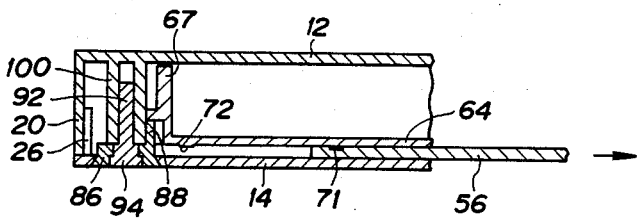
Figure 8:
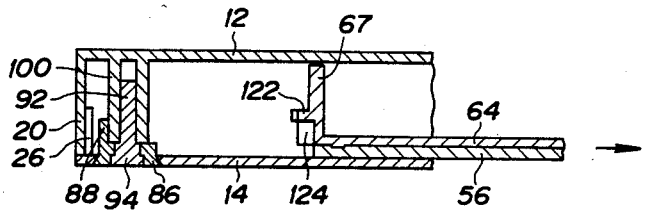

Further, a mechanism is provided to disengage the second drawer 54B from the first drawer 54A and engage the second drawer 54B with the case body 10. A circular hole 80 is formed in the bottom 22 of the lower body 14 at a position adjoining the end wall 26. This hole 80 has the diameter increased from inside toward outside of the bottom wall, and receives a locking member 82 from outside the bottom wall 22. This locking member 82 comprises a countersinking portion 84 which is to be in contact with the inner wall, a cylindrical portion 86 which is to protrude out of the bottom wall 22 through the hole 80, and a fingernail-shaped protrusion 88. Further, a small cylindrical hole 90 is formed through the cylindrical portion 86, and a rod 92 serving as the axis of rotation of the locking member 82 is inserted in the cylindrical hole 90. The rod 92 has a head 94 which is to be fitted in a circular recess 87 formed in the locking member 82. The rod 92 is fitted in a cylindrical hole 110 formed through a column 100 formed integrally with the upper body 12, whereby the locking member 82 touches the inner wall of the circular hole 80 and rotates about the rod 92. On the other hand, the second drawer 54B has formed at the second auxiliary end wall 67 thereof a retaining member 120 so constructed that the fingernail-like protrusion 88 of the locking member 82 is engageable with it. The retaining member 120 is protruded horizontally from the outer lower surface of the end wall 67, and has a horizontal portion 122 at the free end thereof which is so concave as to receive the outer surface of the column 100, and a vertical portion 124 extending vertically down from the mid portion of the horizontal portion 122. When the second drawer 54B is accomodated together with the first drawer 54A in the cigarette case body 10, the concave portion of the horizontal portion 122 of the retaining member 120 gets in contact with the outer circumferential surface of the column 100 of the upper body 12, and by turning the locking member 82 from outside the bottom wall 22 of the lower body 14, the fingernail-like protrusion 88 will be turned to the back of the vertical portion 124 of the retaining member 120 (FIG. 6). At this time, the fingernail-like protrusion 88 will engage the vertical portion 124 and also raise the horizontal portion 122 a little. Thus, the protrusion 72 of the second drawer 54B having so far been engaged in the recess 71 will get out of the recess 71 so that when the first drawer 54A is drawn out of the case body 10 in this condition, only the first drawer 54A will move (FIG. 7) while the second drawer 54B will remain in the case body 10 as locked to the lower body 14. By turning the locking member 82 in the opposite direction, the fingernail-like protrusion 88 will be disengaged from the vertical portion 124 of the retaining member 120 so that the second drawer 54B will be unlocked from the lower body 14 and at the same time it will be locked to the first drawer 54A.

Assume that the second drawer 54B is completely superposed on the first drawer 54A and seven cigarettes are laid on the drawer assembly 54, both the drawers 54A and 54B being accomodated in the cigarette case body 10. With the above-mentioned locking released in this state, draw out the drawer assembly 54 from the cigarette case 10, and all the seven cigarettes will be seen from the outside. On the other hand, pull out the first drawer 54A from the cigarette case body 10 with the locking kept applied, and four of the seven cigarettes will remain in the second section defined by the second auxiliary end walls 66 and 67 and the side wall 24 of the lower body 14 while the remaining three cigarettes will appear as laid in the first section defined by the first auxiliary end wall 62, side wall 61 and a part of the end wall 58.

Figure 9:
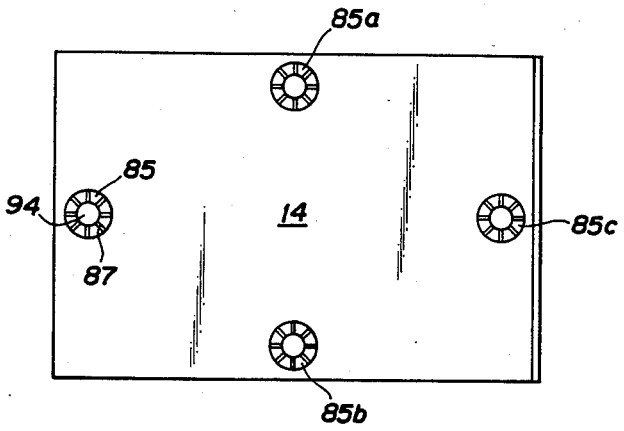

In this embodiment, the locking member 82 is inserted from outside the lower body 14 into the hole 80, and the countersinking portion 84 has a portion 85 exposed at the outer surface of the lower body 14 and on which a plurality of radial ribs 87 is formed for easy turning of the locking member 82. As shown in FIG. 9, the surface of the locking member 82 on which the ribs are formed appears as if it were screwed. Three more similar patterns 85*a*, 85*b* and 85*c* are engraved in the back face of the lower body 14, which camouflage the existence of the locking member 82.

The use of the inventive jugglery means will be briefly described: First when the drawer assembly 54 is pulled out of the cirgarette case body 10, three cigarettes will be seen. One of the three cigarettes is taken out. The drawer assembly 54 is closed into the case 10. After casting a spell on the cigarette case 10, the drawer assembly 54 is pulled out. Three cigarettes will appear again. One cigarette is taken out. Then, the drawer assembly 54 is closed again, and it is pulled out. Here, three cigarettes will appear again. A same action is repeated. But only one cigarette will appear this time. Finally, a spell is cast and the drawer assembly 54 is pulled out. Here, five cigarettes will be seen to the audience. This is a climax of the jugglery using the inventive means.

Figure 3:
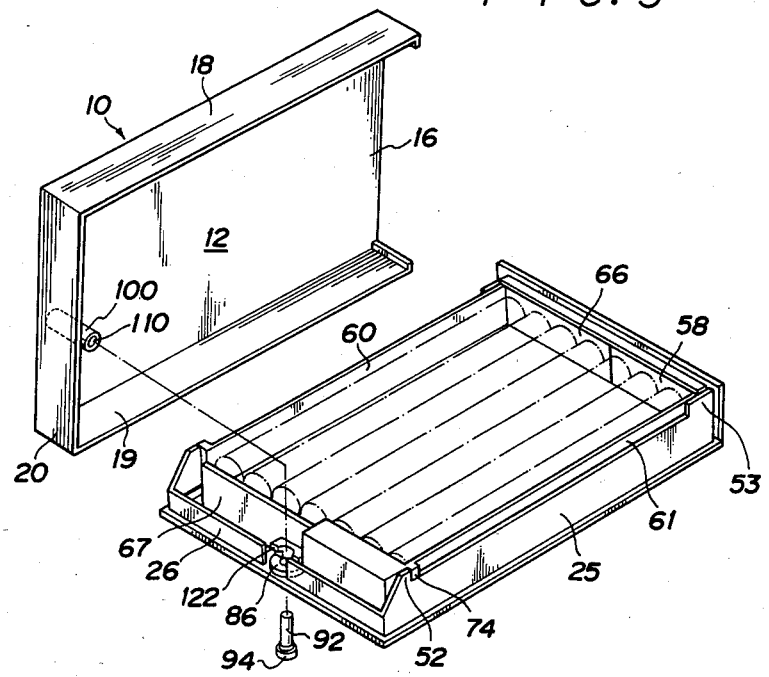
Figure 4:
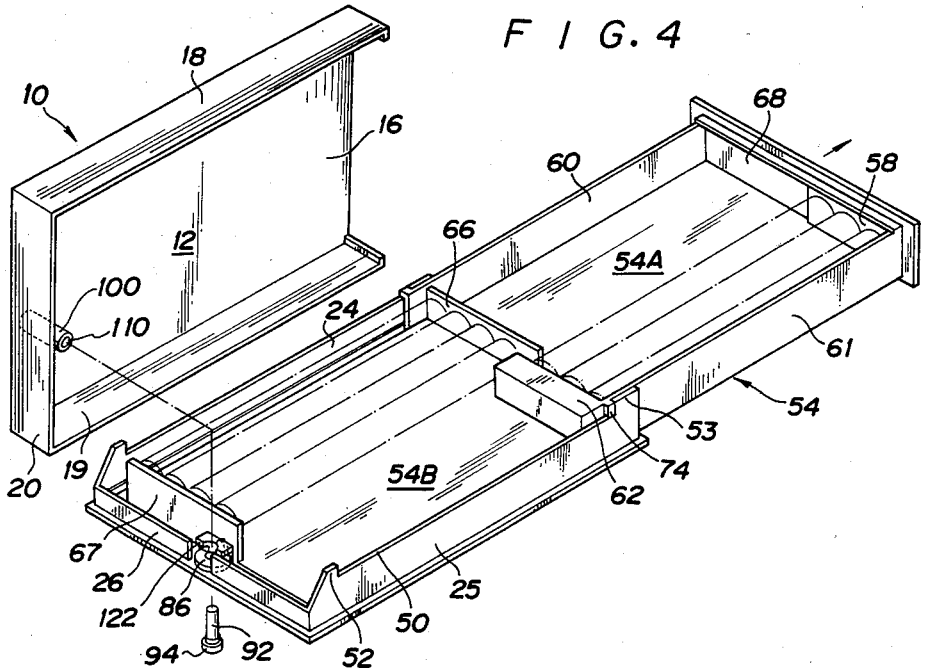
Figure 5:
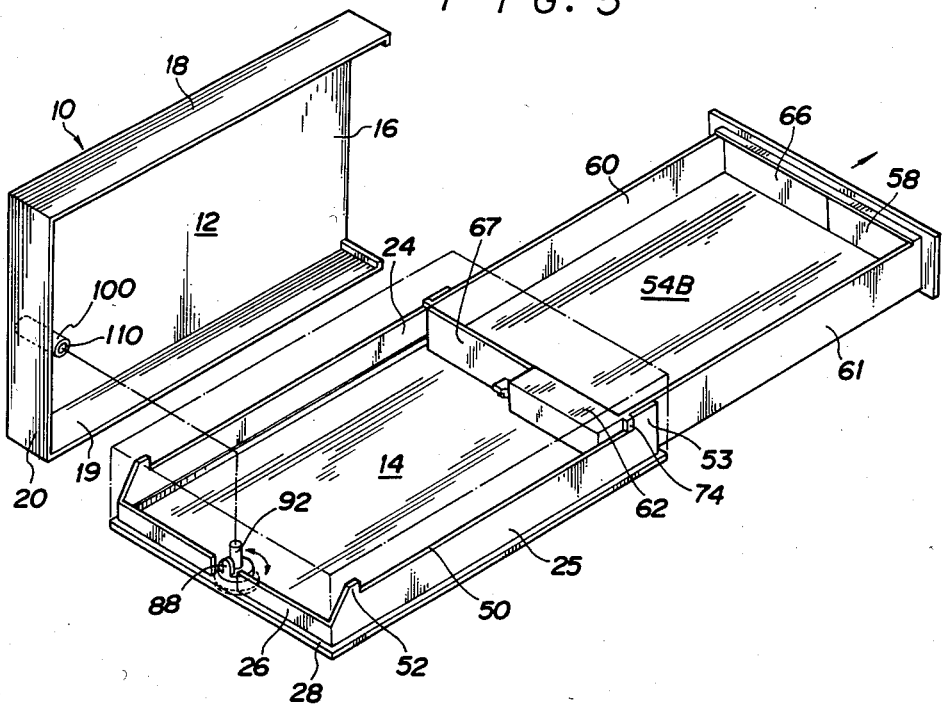
Figure 10:
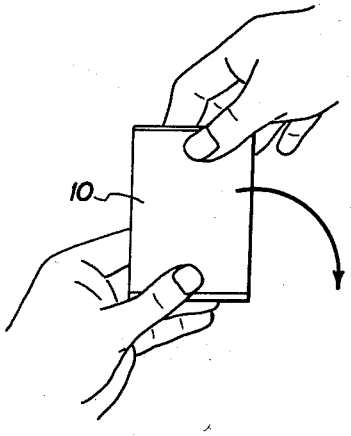
FIGS. 10 thru 22 are explanatory drawings of handling the inventive jugglery means during jugglery.
Figure 11:
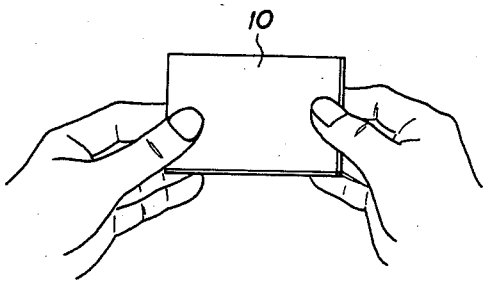
Figure 12:
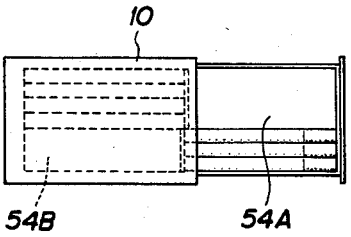

Before playing with this inventive jugglery means, the drawer assembly 54 to be accomodated in the cigarette case body 10 has the first and second drawers 54A and 54B so locked that their relative positions will not change. Namely, the locking member 82 is turned for the fingernail-like protrusion 88 to be disengaged from the retaining member 120 of the second drawer 54B while the protrusion 72 of the second drawer 54B is fitted into the recess 71 in the first drawer 54A, whereby the first and second drawers 54A and 54B will have their relative positions unchanged. In this condition, the drawer assembly 54 is pulled out of the cigarette case 10, and seven cigarettes are put in the drawer assembly 54 (FIG. 5). The drawer assembly 54 is accomodated into the cigarette case 10 once, and the locking member 82 is turned in the opposite direction to engage the fingernail-shaped protrusion 88 on the rear face of the vertical portion 124 of the retaining member 120 of the second drawer 54B, for thereby disengaging the first drawer 54A from the second one 54B (FIG. 3). By pulling out the drawer assembly 54 in this condition, only the first drawer 54A will be pulled out while the second drawer 54B will remain in the cigarette case body 10 (FIG. 4). During this preparatory stage of playing, the cigarette case body 10 is held as shown in FIG. 10. The rotary part 85 of the locking member 82 which is exposed on the rear face of the lower body 14 is pressed by the middle finger of the left hand while the upper body 12 is pressed by the thumb. The other end of the case body 10 is held by the right hand and turned clockwise toward the player (FIG. 11). The first drawer 54A will be disengaged from the second drawer 54B, and when the first drawer 54A alone is pulled out, only the three cigarettes laid in the first section will appear to the audience (FIG. 12). Then the first drawer 54A is returned into the case body 10 and the cigarette case 10 is put on a table or into the pocket of player's suit. Here, the preparation is over.

Figure 14:
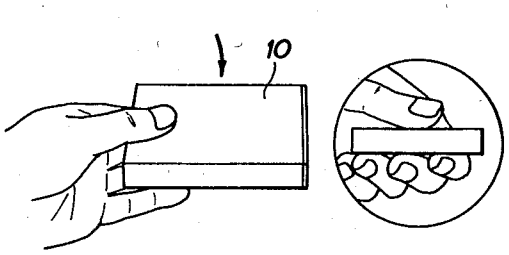
Figure 13:
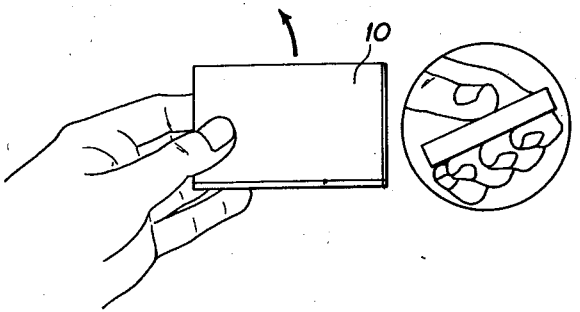
Figure 16:
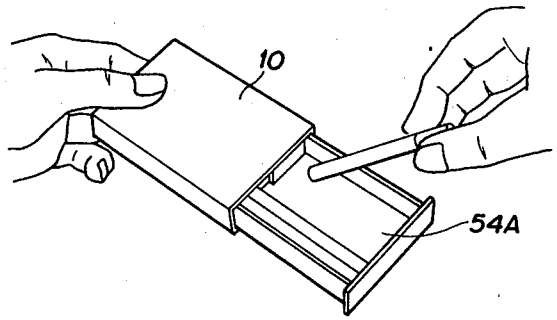
Figure 15:
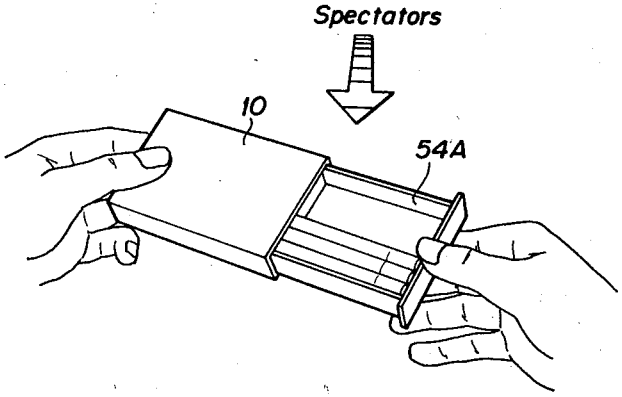
Figure 18:
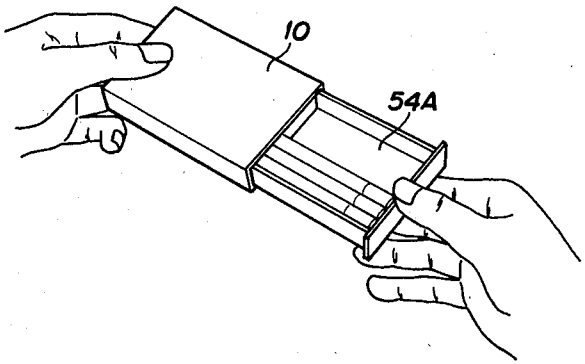
Figure 20:
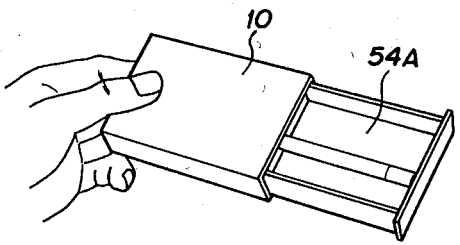
Figure 17:
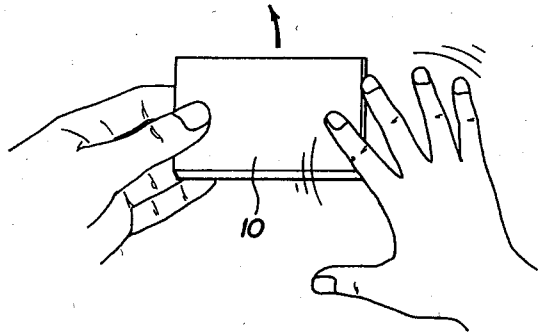
Figure 19:
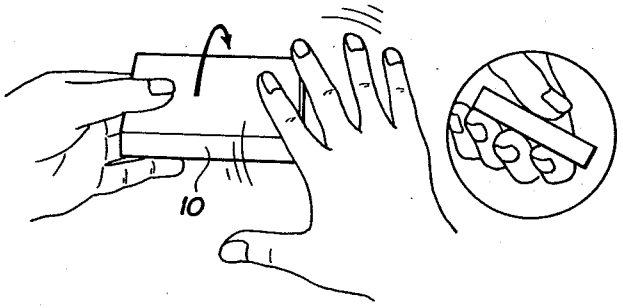
Figure 21:
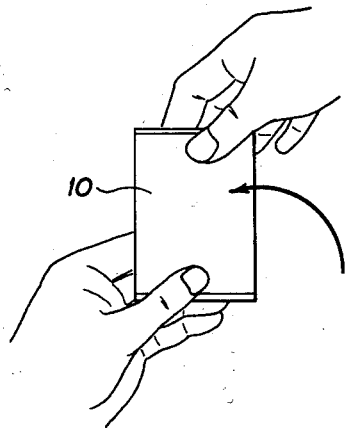
Figure 22:
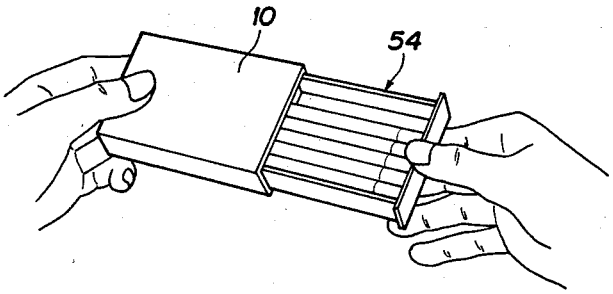

The inventive jugglery means is to be used as follows:

First, the player takes the cigarette case 10 from on the table or inside the pocket of his suit. He holds the cigarette case 10 and inclines it a little from horizontal toward him (FIG. 13) so that three of the seven cigarettes will be disposed in the first section defined by the first auxiliary end wall 62, side wall 61 and a part of the end wall 58 of the first drawer 54A. Then he returns the cigarette case 10 to horizotal position (FIG. 14). After that, he pulles the drawer assembly 54 out of the case 10. He shows three cigarettes laid in the first drawer 54A to the audience (FIG. 15). When pulling out the first drawer 54A, he should hold the cigarette case 10 inclined at such an angle that the inner end of the drawer assembly 54 will not be seen to the audience. For example, the existence of the auxiliary end walls of the drawer assembly 54 will not be recognized by the audience if the angle formed between the audience glance and the moving direction of the drawer assembly 54 is more than 90 degrees. Then the player says to the audience "This is a very convenient cigarette case. This case contains three cigarettes now. I'll take out one of them." And he takes one cigarette by the right hand (FIG. 16) and puts it on the table. He returns the drawer assembly 54 into the case 10, and makes a gesture of casting a spell on the case body 10 by the right hand. While attracting the audience's attention in this way, he inclines the case body 10 a little from horizontal toward himself (FIG. 17). Thus, the cigarettes in the drawer assembly 54 will roll a little therein and move toward the player. Then, he returns the case body 10 to the horizontal position. When he pulls out the drawer assembly 54 here, only the first drawer 54A will be drawn and three cigarettes in the first section will be seen to the audience (FIG. 18). Here he says to the audience "This spell casting restores the initial number of cigarettes. Now let me try again." He pulls out the drawer assembly 54 from the cigarette case 10 and takes out one cigarette. Showing the cigarettes in the case 10 to the audience, he closes the drawer assembly 54. While casting a spell as before, he inclines the case body 10 by the left hand toward him. Then he returns the case 10 to the horizontal position. When the drawer assembly 54 is pulled out by the right hand, three cigarettes will appear again. The player says to the audience "Even after one cigarette is taken out, the initial three cigarettes will be restored evey time I open the drawer with the spell casting. But there is one thing troublesome to me. It's a request for one cigarette. In such case, . . . " Here he close the drawer assembly without taking out any cigarette. Casting a spell by the right hand, he inclines the cigarette case a little from horizontal toward the audience (FIG. 19). At this time, the cigarette case contains five cigarettes; four of them will move into the second section while the other one cigarette remains in the first section. Here, he returns the case body 10 to the horizontal position and pulls out the drawer assembly 54. The one cigarette will appear to the audience (FIG. 20). The player says at this time to the audience "I make it a rule to thus cast a spell and say to the requesting person that since there remains only one cigarette, I cannot give it to you." And he closes the drawer assembly 54 by the right hand and holds the case body by the left hand. While pressing the rotary part 85 of the locking member 82 by the end of the middle finger of the left hand and pressing the upper wall of the case body 10 by the thumb, the player holds the right end of the case 10 by the right hand and turns the case counterclockwise toward the audience as shown in FIG. 21. And he casts a spell on the case by the right hand. Thus, the fingernail-like protrusion 88 is so turned as to be disengaged from the retaining member 120 of the second drawer 54B while the latter will be engaged on the first drawer 54A. These drawers 54A and 54B are thus registered each on the other. When the drawer assembly 54 is pulled out in this condition, both the first and second drawers 54A and 54B will be pulled out together. Here, saying to the audience "After that, with another spell, I can produce many cigarettes like this", the player pulls out the drawer assembly 54. The remaining five cigarettes will appear to the audience, making a climax of the playing (FIG. 22).

As having been explained in the foregoing, the embodiment of the inventive jugglery means is so constructed that three cigarettes are disposed in the first section defined by a part of the end wall 58, side wall 61 and first auxiliary end wall 62 of the first drawer 54A while four cigarettes are disposed in the second section defined by the second auxiliary end walls 66 and 67 of the second drawer 54B and the side wall 60 of the first drawer 54A or side wall 24 of the lower body 14. However, the present invention is not limited to this embodiment. For example, the inventive jugglery means may be so constructed that the first section contains three cigarettes while the second section contains five cigarettes, whereby a same amusement can be provided.

As previously described, the jugglery means using cigarettes according to the present invention provides various many modes of amusement. It will be apparent to those skilled in the art that the embodiment having been described and illustrated is just one example of such amusement.

What is claimed is:

1. A jugglery device using cigarettes, comprising:

a hollow rectangular parallelpiped casing formed by generally rectangular upper and bottom walls disposed opposite to each other, a pair of side walls connecting opposite side edges of said upper and bottom walls and an end wall by which opposite end edges of said upper and bottom walls are connected to each other;

a drawer assembly disposed slidably in relation to said bottom wall through the open end of said casing and in which a plurality of cigarettes is accommodated, having a bottom wall slidable on the bottom wall of said casing, a pair of side walls formed as vertically raised from the opposite side walls, respectively, of said bottom wall, an end wall formed to cover the open end of said casing and which connects the opposite end edges of said side walls, and a first auxiliary end wall protruding from one of the other opposite end edges of one of said side walls toward the other end edge of the other of said side walls;

a second bottom wall disposed slidably on the bottom wall of said drawer assembly and which is of a nearly same area as the bottom wall of the drawer assembly, in which a pair of second auxiliary end walls are formed as vertically raised from a part of the opposite end edges, one of the second auxiliary end walls touching a part of said end wall of the drawer assembly when said drawer assembly is in the minimum sliding position in relation to the second bottom wall, while the other second auxiliary end wall forms together with said first auxiliary end wall another end wall of the drawer assembly; and first means of releasably engaging said second bottom wall with said drawer assembly and second means of releasably engaging said second bottom wall with said casing, said second means controlling the release of said first means whereby if said second means on manual operation releases said first means only the drawer assembly can be drawn out and if the second means permits locking of said first means then the drawer assembly and said second bottom wall can be drawn out as one unit.

2. A jugglery device using cigarettes as set forth in claim 1, in which each side wall of said drawer assembly has formed therein a horizontally extending elongated guide recess and said second bottom wall has formed thereon a pair of opposite protrusions which are fitted in the guide recesses.

3. A jugglery device using cigarettes as set forth in claim 1, said first and second means of releasably engaging comprising:

said first means of engagement composed of a recess formed in the bottom wall of said drawer assembly and a protrusion formed in a position corresponding to said recess in said second bottom wall; and said second means of engagement composed of a rotary member rotatably fitted in said casing and which has a fingernail-like protrusion with an engaging face in the direction of rotation and a retaining member fixed on the outer surface of said other second auxiliary end wall and which engages said fingernail-like protrusion, said fingernail-like protrusion raising said drawer assembly when it engages said retaining member to disengage said drawer assembly from said second bottom wall.

4. A jugglery device using cigarettes as set forth in claim 1, in which said casing comprises an upper casing formed by an upper wall, a pair of side walls extending from the side edges, respectively, of said upper wall and an end wall, and a lower casing formed by a bottom wall, a pair of inner walls engageable on the inner surfaces, respectively of said side walls and an inner end wall engageable on the inner surface of said end wall.

5. A jugglery device using cigarettes as set forth in claim 4, in which the side walls of said drawer assembly have a pair of protrusions formed at the opposite outer surfaces thereof and said lower casing has formed in the inner walls thereof a pair of guide ways to support said pair of protrusions and guide the drawer assembly in the direction of sliding.

6. A jugglery device using cigarettes as set forth in claim 5, in which said guide ways have formed at the opposite ends thereof shoulder pieces which limit the sliding distance of said drawer assembly.

7. A jugglery device using cigarettes as set forth in claim 5, in which the length of said first auxiliary end wall generally corresponds to the width of three cigarettes and the length of said second auxiliary end walls generally corresponds to the width of four cigarettes.

8. A jugglery device using cigarettes as set forth in claim 1, in which the length of said drawer assembly in the direction of sliding generally corresponds to the that of cigarettes and the distance between the side walls generally corresponds to the width of seven cigarettes.

9. A jugglery device using cigarettes, comprising:

a hollow rectangular parallelpiped casing formed by generally rectangular upper and bottom walls disposed opposite to each other, a pair of side walls connecting opposite side edges of said upper and bottom walls and an end wall by which opposite end edges of said upper and bottom walls are connected to each other;

a drawer assembly disposed slidably in relation to said bottom wall through the open end of said casing, having a bottom wall slidable on the bottom wall of said casing, a pair of side walls formed as vertically raised from the opposite side walls, respectively, of said bottom wall, an end wall formed to cover the open end of said casing and which connects the opposite end edges of said side walls, and a first auxiliary end wall protruding from one of the other opposite end edges of one of said side walls toward the other end edge of the other of said side walls;

a second bottom wall disposed slidably on the bottom wall of said drawer assembly and which is of a nearly same area as the bottom wall of the drawer assembly, in which a pair of second auxiliary end walls are formed as vertically raised from a part of the opposite end edges, one of the second auxiliary end walls touching a part of said end wall of the drawer assembly when said drawer assembly is in the minimum sliding position in relation to the second bottom wall, while the other second auxiliary end wall forms together with said first auxiliary end wall another end wall of the drawer assembly;

plural dummy cigarettes to be laid on said second bottom wall; and first means of releasably engaging said second bottom wall with said drawer assembly and second means of releasably engaging said second bottom wall with said casing, said second means controlling the release of said first means whereby if said second means on manual operation releases said first means only the drawer assembly can be drawn out and if the second means permits locking of said first means then the drawer assembly and said second bottom wall can be drawn out as one unit, the ones of the dummy cigarettes which are in the section defined by the first auxiliary end wall, one of the side walls and a part of the end wall of said drawer assembly appearing when the drawer assembly is drawn out of the casing, while the cigarettes lying between the second auxiliary end walls in pair will remain in the casing and all the cigarettes appearing when the drawer assembly and the second bottom wall are drawn out as one unit.

* * * * *